US010019921B2

(12) United States Patent
Lim

(10) Patent No.: US 10,019,921 B2
(45) Date of Patent: Jul. 10, 2018

(54) DATA DRIVER AND DISPLAY DEVICE HAVING THE SAME

(71) Applicant: SAMSUNG DISPLAY CO., LTD., Yongin-si, Gyeonggi-do (KR)

(72) Inventor: Hyun-Ho Lim, Jecheon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 363 days.

(21) Appl. No.: 14/846,721

(22) Filed: Sep. 4, 2015

(65) Prior Publication Data

US 2016/0307543 A1 Oct. 20, 2016

(30) Foreign Application Priority Data

Apr. 20, 2015 (KR) ..... 10-2015-0055438

(51) Int. Cl.
*G09G 3/20* (2006.01)

(52) U.S. Cl.
CPC ..... *G09G 3/20* (2013.01); *G09G 2310/0243* (2013.01); *G09G 2310/0275* (2013.01); *G09G 2320/0223* (2013.01); *G09G 2330/021* (2013.01)

(58) Field of Classification Search
CPC ..... G09G 5/18; G09G 2330/021; G09G 2310/0243; G09G 2310/0264; G09G 2310/0286; G09G 2310/08; G09G 2320/0223; G09G 2310/0275; G09G 3/20
See application file for complete search history.

(56) References Cited

U.S. PATENT DOCUMENTS

| | | | | |
|---|---|---|---|---|
| 8,674,969 | B2 * | 3/2014 | Ooga | G09G 3/20 345/173 |
| 9,076,390 | B2 * | 7/2015 | Kaplan | G09G 3/3413 |
| 9,262,998 | B2 * | 2/2016 | Chiang | G09G 5/18 |
| 9,747,832 | B2 * | 8/2017 | Kim | G09G 3/2022 |
| 2003/0132903 | A1 * | 7/2003 | Ueda | G09G 3/3614 345/87 |
| 2003/0151713 | A1 * | 8/2003 | Aoki | G09G 3/3688 349/149 |

(Continued)

FOREIGN PATENT DOCUMENTS

| | | | |
|---|---|---|---|
| KR | 10-1151286 | B1 | 6/2012 |
| KR | 10-2012-0071848 | A | 7/2012 |
| KR | 10-2012-0134238 | A | 12/2012 |

OTHER PUBLICATIONS

Korean Patent Abstracts of Korean Publication No. 10-2007-0002141 A, dated Jan. 5, 2007, Corresponding to Korean Patent No. 10-1151286 B1, dated Jun. 8, 2012, 1 Page.

*Primary Examiner* — Antonio Xavier
(74) *Attorney, Agent, or Firm* — Lewis Roca Rothgerber Christie LLP

(57) ABSTRACT

According to some example embodiments, there is provided a display device including a display panel including a plurality of pixels, a scan driver configured to provide a plurality of scan signals to the pixels through a plurality of scan lines, a data driver configured to adjust an output timing of a data signal of a plurality of data signals according to a distance from a target pixel of the pixels, and to provide the data signal to the pixels through a plurality of data lines, and a timing controller configured to control the scan driver and the data driver.

16 Claims, 6 Drawing Sheets

(56) References Cited

U.S. PATENT DOCUMENTS

2004/0212577 A1* 10/2004 Takeda ..... G09G 3/3648 345/99
2005/0156851 A1* 7/2005 Yun ..... G09G 3/2092 345/98
2006/0164375 A1* 7/2006 Kim ..... G09G 3/3685 345/100
2007/0046601 A1* 3/2007 Shin ..... G09G 3/3607 345/89
2007/0146354 A1* 6/2007 Kubota ..... G09G 3/2011 345/204
2008/0129869 A1* 6/2008 Jeon ..... H04N 17/04 348/500
2008/0198118 A1* 8/2008 Choi ..... G09G 3/3648 345/89
2009/0066681 A1* 3/2009 Kim ..... G09G 3/2007 345/210
2011/0199369 A1 8/2011 Huang et al.
2013/0214334 A1* 8/2013 Masuoka ..... H01L 27/14643 257/258
2013/0314394 A1* 11/2013 Chaji ..... G09G 3/00 345/212
2014/0168199 A1* 6/2014 Yanagi ..... G09G 5/18 345/213
2015/0097871 A1* 4/2015 Kumeta ..... G09G 3/2003 345/690
2015/0187280 A1* 7/2015 Park ..... G09G 3/3291 345/691
2017/0076663 A1* 3/2017 Nishimura ..... G09G 3/3266

* cited by examiner

DATA DRIVER AND DISPLAY DEVICE HAVING THE SAME

CROSS REFERENCE TO RELATED APPLICATION

This application claims priority to and the benefit of Korean patent Application No. 10-2015-0055438, filed on Apr. 20, 2015, the disclosure of which is hereby incorporated by reference herein in its entirety.

BACKGROUND

1. Field

Aspects of example embodiments of the inventive concept relate to a display device.

2. Description of the Related Art

Flat panel display (FPD) devices are widely used as display devices of electronic devices because the FPD devices are relatively lightweight and thin compared to cathode-ray tube (CRT) display device. Examples of FPD devices include liquid crystal display (LCD) devices, plasma display panel (PDP) devices, and organic light emitting display (OLED) devices.

Generally, the display device includes a display panel and a panel driver for driving the display panel. The display panel includes a plurality of scan lines, a plurality of data lines, and a plurality of pixels. The panel driver includes a scan driver providing a plurality of scan signals to the pixels and a data driver providing a plurality of data signals to the pixels.

SUMMARY

Aspects of example embodiments of the present invention are directed toward a display device capable of reducing power consumption.

Aspects of example embodiments of the present invention are directed towards a data driver for the display device.

According to some example embodiments, there is provided a display device including: a display panel including a plurality of pixels; a scan driver configured to provide a plurality of scan signals to the pixels through a plurality of scan lines; a data driver configured to adjust an output timing of a data signal of a plurality of data signals according to a distance from a target pixel of the pixels, and to provide the data signal to the pixels through a plurality of data lines; and a timing controller configured to control the scan driver and the data driver.

In an embodiment, the data driver is configured to output the data signal such that the output timing of the data signal is advanced within one horizontal period as a distance between the data driver and the target pixel of the pixels increases.

In an embodiment, the data driver includes: a shift register configured to shift a horizontal start signal synchronizing a data clock signal to generate a sampling signal; a latch circuit configured to latch input data in response to the sampling signal, and to output the latched input data in response to a load signal; a signal controller configured to adjust an output timing of the load signal according to the distance from the pixels, and to provide the load signal to the latch circuit; a digital-to-analog converter configured to convert the latched input data into the data signals of analog-type based on a gamma reference voltage set; and an output buffer configured to output the data signals to the data lines.

In an embodiment, the signal controller outputs the load signal in every horizontal period.

In an embodiment, the horizontal period includes a horizontal blank period and a data outputting period, and the signal controller is configured to output the load signal for at least a portion of the horizontal blank period.

In an embodiment, the signal controller decreases an output time difference between a start time of the horizontal blank period and the output timing of the load signal as a distance between the data driver and the pixels increases.

In an embodiment, the signal controller is configured to calculate the output time difference for each of the pixels using an interpolation method.

In an embodiment, the signal controller is configured to adjust the output timing of the load signal such that the pixels are charged with the data signals within a target charging time.

In an embodiment, the display panel includes a plurality of pixel regions, and the signal controller is configured to set the output timing of the load signal for each of the pixel regions.

In an embodiment, the signal controller is configured to output the load signal such that the output timing of the load signal is advanced as a distance between the data driver and the pixels increases.

In an embodiment, a quantity of the pixel regions corresponds to a size of a protocol for setting the output timing of the load signal.

In an embodiment, the scan driver is configured to progressively output the scan signals to the scan lines, and the signal controller is configured to control the output timing of the load signal using a counter that is increased in every horizontal period.

In an embodiment, the scan driver is configured to output the scan signals to the scan lines in a set order, and the signal controller is configured to control the output timing of the load signal based on the scan signals.

In an embodiment, the signal controller is further configured to receive a control signal from the timing controller, and to provide the horizontal start signal and the data clock signal to the shift register based on the control signal.

According to some example embodiments, there is provided a data driver including: a shift register configured to shift a horizontal start signal synchronizing a data clock signal to generate a sampling signal; a latch circuit configured to latch input data in response to the sampling signal, and to output the latched input data in response to a load signal; a signal controller configured to adjust an output timing of the load signal according to a distance from a plurality of pixels, and to provide the load signal to the latch circuit; a digital-to-analog converter configured to convert the latched input data into a plurality of data signals of analog-type based on a gamma reference voltage set; and an output buffer configured to output the data signals to a plurality of data lines.

In an embodiment, the signal controller is configured to output the load signal in every horizontal period.

In an embodiment, the horizontal period includes a horizontal blank period and a data outputting period, and the signal controller is configured to output the load signal for at least a portion of the horizontal blank period.

In an embodiment, the signal controller is configured to decrease an output time difference between a start time of the horizontal blank period and the output timing of the load signal as a distance between the data driver and the pixels increases.

In an embodiment, the signal controller is configured to calculate the output time difference for each of the pixels using an interpolation method.

In an embodiment, the signal controller is configured to adjust the output timing of the load signal such that the pixels are charged with the data signals within a target charging time.

Therefore, a display device according to example embodiments decreases the voltage (e.g., unnecessary voltage) for charging pixels and reduces power consumption by adjusting an output timing of a data signal according to a distance between a data driver and the pixels. Because a heat generated by the display device is decreased as the power consumption decreases, the size of the driver integrated circuit may be decreased.

In addition, a data driver according to example embodiments efficiently drives the display device.

BRIEF DESCRIPTION OF THE DRAWINGS

Exemplary embodiments will be described more fully hereinafter with reference to the accompanying drawings, in which various embodiments are shown.

DESCRIPTION OF EMBODIMENTS

Exemplary embodiments will be described more fully hereinafter with reference to the accompanying drawings, in which various embodiments are shown.

Figure 1:
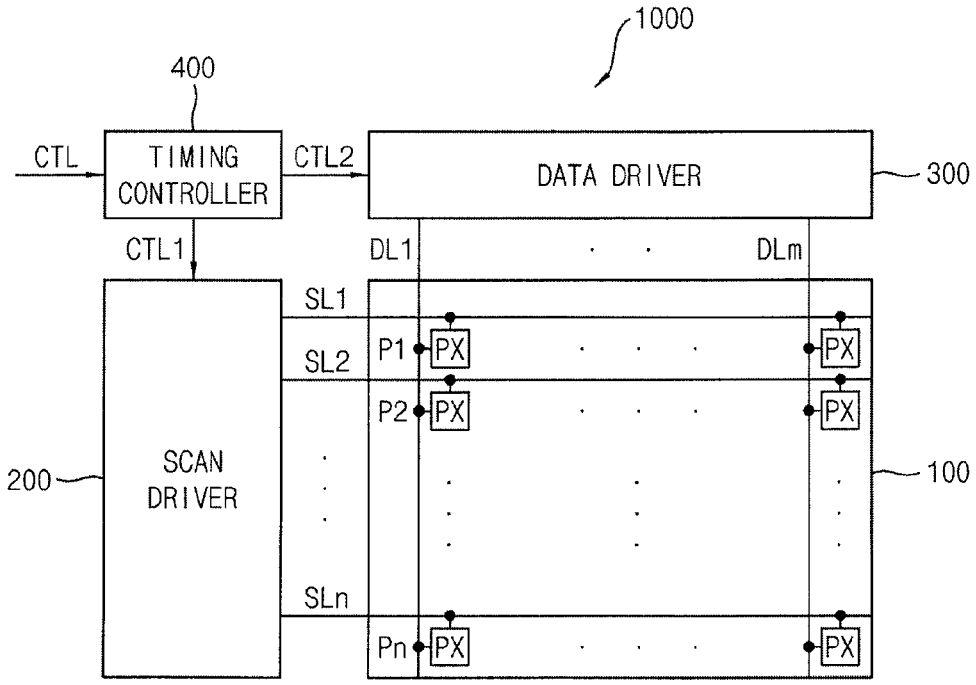
FIG. 1 is a block diagram illustrating a display device according to example embodiments of the present invention.

FIG. 1 is a block diagram illustrating a display device according to example embodiments.

Referring to FIG. 1, the display device may include a display panel 100, a scan driver 200, a data driver 300, and a timing controller 400.

The display panel 100 may include a plurality of pixels PX to display an image. The display panel 100 may be connected to the scan driver 200 via a plurality of scan lines SL1 through SLn. The display panel 100 may be connected to the data driver 300 via a plurality of data lines DL1 through DLm. The display panel 100 may include n*m pixels PX because the pixels PX are arranged at locations corresponding to crossings (e.g., crossing points) of the scan lines SL1 through SLn and the data lines DL1 through DLm.

The scan driver 200 may provide a plurality of scan signals to the pixels PX through a plurality of scan lines SL1 through SLn. In one example embodiment, the scan driver 200 may progressively output the scan signals to the scan lines SL1 through SLn to drive the display panel 100 by an analog driving technique with a progressive scan manner. In another example embodiment, the scan driver 200 may output the scan signals to the scan lines SL1 through SLn in an order (e.g., a predetermined order) to drive the display panel 100 by a digital driving technique.

The data driver 300 may adjust an output timing of a data signal according to a distance from the pixels PX. The data driver 300 may provide the data signal to the pixels PX through the data lines DL1 through DLm. In one example embodiment, the data driver 300 may output the data signal such that the output timing of the data signal is advanced (e.g., decreased) within one horizontal period as a distance between the data driver 300 and the pixels PX increases. A line load (e.g., the line impedance resulting from, e.g., line resistance and parasitic capacitance) of the data line may increase as the distance between the data driver 300 and the pixel PX increases. Therefore, when the data signal is for a far pixel for which the distance from the data driver 300 is relatively long (e.g., a pixel connected to an (N)th node Pn), the data driver 300 may output the data signal such that the output timing of the data signal is fast (e.g., is minimally or not delayed) to secure a charging time of the pixel PX (i.e., to charge the pixel connected to the (N)th node Pn within the charging time). On the other hand, when the data signal is for a near pixel for which the distance from the data driver 300 is relatively short (e.g., a pixel connected to a first node P1), the data driver 300 may output the data signal such that the output timing of the data signal is slow (e.g., delayed) to reduce power consumption.

In one example embodiment, the data driver 300 may control an output timing of a load signal to adjust the output timing of the data signal. Hereinafter, a structure of the data driver 300 will be described in more detail with reference to FIG. 4.

The timing controller 400 may control the scan driver 200 and the data driver 300 to display an image. The timing controller 400 may provide a first control signal CTL1 to the scan driver 200 and provide a second control signal CTL2 to the data driver 300 to control the scan driver 200 and the data driver 300.

In one example embodiment, the display device 1000 may be an organic light emitting display device. In this case, the display device 1000 may further include a power supply providing a high power voltage and a low power voltage to the pixels PX, an emission driver providing an emission signal to the pixels PX, etc.

Therefore, the display device 1000 may adjust the output timing of the data signal according to the distance between the data driver 300 and the pixels PX. Accordingly, the display device 1000 may decrease the voltage (e.g., unnecessary voltage) for charging (at least some) pixels and reduce power consumption. Also, the display device 1000 may decrease a size of driver integrated circuit (IC) because a heat generated by the display device 1000 is decreased as the power consumption decreases.

Figure 2:
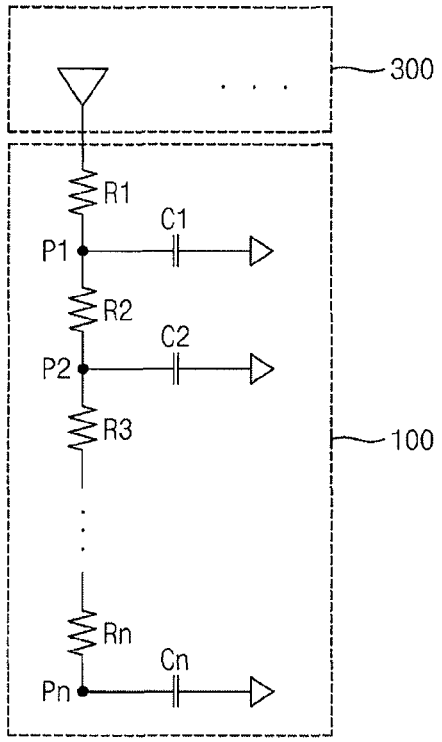
FIG. 2 is a diagram for illustrating an example of a line load occurring in a display panel included in a display device of FIG. 1.
Figure 3:
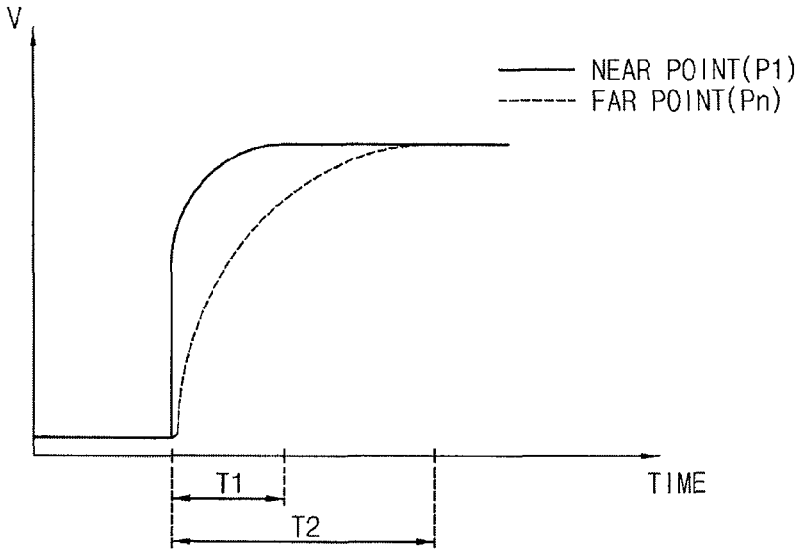
FIG. 3 is a graph illustrating a charging time according to a position of a pixel.

FIG. 2 is a diagram for illustrating an example of a line load occurring in a display panel included in a display device of FIG. 1. FIG. 3 is a graph illustrating a charging time according to a position of a pixel.

Referring to FIGS. 2 and 3, a line load of a data line may increase as a distance between a data driver 300 and a pixel increases. Therefore, the pixel is affected by (e.g., relatively largely) affected by the line load, and a charging time of a data signal is increased as the distance between the data driver 300 and the pixel increases.

As shown in FIG. 2, the line load of the data line may increase as the distance between the data driver 300 and the pixel increases. Generally, the line load linearly increases as the distance between the data driver 300 and the pixel increases. For example, a line load for the first node P1 that is located nearest to the data driver 300 may be determined according to a first resistance R1 and a first capacitance C1. Accordingly, the first pixel connected to the first node P1 may be relatively less affected by the line load. On the other hand, a line load for the (N)th node Pn that is located farthest from the data driver 300 may be determined according to first through (N)th resistance R1 through Rn and first through (N)th capacitors C1 through Cn. Accordingly, the (N)th pixel connected to the (N)th node Pn may be relatively more affected by the line load.

As shown in FIG. 3, in the first node P1, an RC delay resulting from the line load may be relatively small. Therefore, a first charging time T1 of the data signal for the first pixel connected to the first node P1 may be relatively short. On the other hand, in the (N)th node Pn, an RC delay resulting from the line load may be relatively large. Therefore, a second charging time T2 of the data signal for the (N)th pixel connected to the (N)th node Pn may be relatively long.

Figure 4:
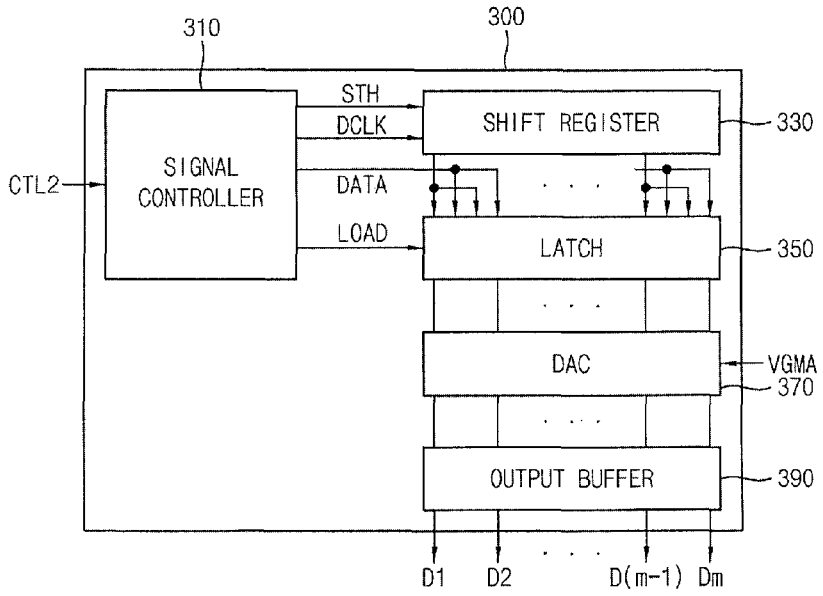
FIG. 4 is a block diagram illustrating an example of a data driver included in a display device of FIG. 1.

FIG. 4 is a block diagram illustrating an example of a data driver included in a display device of FIG. 1.

Referring to FIG. 4, the data driver 300 may include a signal controller 310, a shift register 330, a latch circuit 350, a digital-to-analog converter 370, and an output buffer 390.

The signal controller 310 may receive a second control signal CTL2 from the timing controller. The signal controller 310 may generate signals for controlling the shift register 330 and the latch circuit 350 based on the second control signal CTL2. For example, the signal controller 310 may generate a horizontal start signal STH and a data clock signal DCLK based on the second control signal CTL2 and provide the horizontal start signal STH and the data clock signal DCLK to the shift register 330. Also, the signal controller 310 may generate a load signal LOAD based on the second control signal CTL2 and provide the load signal LOAD to the latch circuit 350.

The signal controller 310 may adjust an output timing of the load signal LOAD according to the distance from the pixels. In one example embodiment, the signal controller 310 may decrease an output time difference (e.g., output distance or output delay) between a start time of the horizontal blank period and the output timing of the load signal LOAD as a distance between the data driver 300 and the pixels increases. Thus, the signal controller 310 may adjust the output time difference between the start time of the horizontal blank period and the output timing of the load signal LOAD to adjust the output timing of the data signal. The line load of the data line may increase as a distance between the data driver 300 and the pixel increases. Therefore, the signal controller 310 may decrease the output time difference for a far pixel for which distance from the data driver 300 is relatively long to secure the charging time. Also, the signal controller 310 may increase the output time difference for a near pixel for which distance from the data driver 300 is relatively short to reduce power consumption.

In one example embodiment, the signal controller 310 may adjust the output timing of the load signal LOAD such that the pixels are charged with the data signal within a target charging time. Thus, in order to correctly display an image, it is desirable secure the charging time (i.e., to charge the data signal within the target time). Also, the output time difference for each pixel may be calculated using an interpolation method. For example, the first pixel that is located nearest to the data driver 300 may be little affected (e.g., minimally affected) by the line load. Accordingly, the charging time of the first pixel may be short. Therefore, a first output timing of the load signal LOAD for the first pixel may be set slowly (e.g., may be significantly or maximally delayed). The (N)th pixel that is located farthest from the data driver 300 may be largely affected by the line load. Accordingly, the charging time of the (N)th pixel may be long. Therefore, an (N)th output timing of the load signal LOAD for the first pixel may be set fast (may not be delayed or may be minimally delayed). Output timings for the second through (N−1)th pixels may then be calculated using the first output timing and the (N)th output timing by the interpolation method.

In one example embodiment, the signal controller 310 may output the load signal LOAD in every horizontal period. Here, the horizontal period indicates a time for transmitting the data signal to one horizontal line or one scan line. The signal controller 310 may output the load signal LOAD in every horizontal period to adjust the output timing of the data signal within one horizontal period. In one example embodiment, the horizontal period may include a horizontal blank period and a data outputting period. The signal controller 310 may transmit protocol data during the horizontal blank period. The signal controller 310 may output the load signal LOAD for at least a portion of the horizontal blank period. The signal controller 310 may output the data signal for each horizontal line during the data outputting period.

In one example embodiment, the signal controller 310 may control the output timing of the load signal LOAD using a counter that is increased in every horizontal period. For example, in the display device driven by an analog driving technique with progressive scan manner. The distance between the data driver 300 and the pixel may increase in every horizontal period. Accordingly, the signal controller 310 may set the output timing of the load signal LOAD to correspond to the distance between the data driver 300 and the pixel using the counter. In another example embodiment, the signal controller 310 may control the output timing of the load signal LOAD based on the scan signals. For example, in the display device driven by a digital driving technique, the scan signals may be outputted to the scan lines in an order (e.g., a predetermined order). In this case, the distance between the data driver 300 and the pixel to which the data signal is outputted may be determined based on the control information for controlling the scan signals. Therefore, the signal controller 310 may output the load signal LOAD based on the scan signals.

The shift register 330 may receive the horizontal start signal STH and the data clock signal DCLK from the signal controller 310. The shift register 330 may shift a horizontal start signal synchronizing a data clock signal to generate a sampling signal.

The latch circuit 350 may latch input data DATA in response to the sampling signal. The latch circuit 350 may output the latched input data in response to the load signal LOAD. In one example embodiment, the latch circuit 350 may output the latched input data in response to the load signal LOAD in every horizontal period.

The digital-to-analog converter 370 may convert the latched input data into the data signals of analog-type (e.g., into analog data signals) based on a gamma reference voltage set VGMA.

The output buffer 390 may output the data signals D1 through Dm to the data lines.

Figure 5:
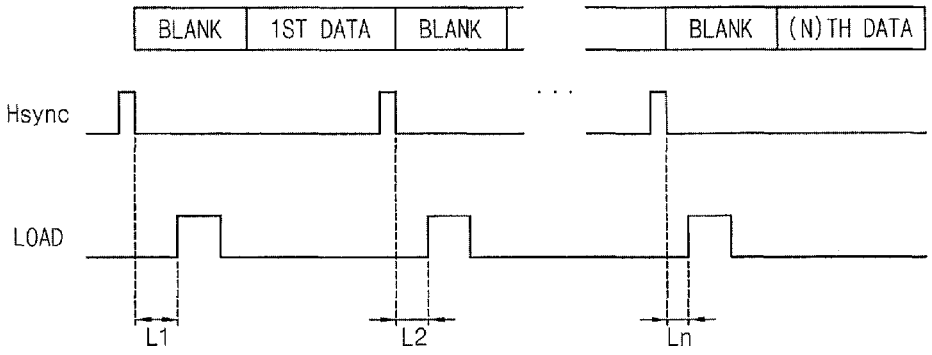
FIG. 5 is a waveform illustrating a horizontal synchronization signal and a load signal for controlling a data driver of FIG. 4.

FIG. 5 is a waveform illustrating a horizontal synchronization signal and a load signal for controlling a data driver of FIG. 4.

Referring to FIG. 5, the horizontal synchronization signal Hsync may be outputted at the start time of every horizontal period. The horizontal period may include a horizontal blank period BLANK and a data outputting period (N)th DATA. Protocol data may be outputted during the horizontal blank period BLANK. Therefore, the load signal LOAD may be outputted for at least a portion of the horizontal blank period.

The output timing of the load signal LOAD may be adjusted according to a distance from each of the pixels. In one example embodiment, the signal controller may decrease an output time difference between the start time of the horizontal blank period BLANK and the output timing of the load signal LOAD as a distance between the data driver and the pixels increases. In a first horizontal period corresponding to a first pixel that is located nearest to the data driver, a first output time difference L1 may be relatively large to reduce power consumption. In a second horizontal period corresponding to a second pixel that is located in the farther distance from the data driver compared to the first pixel, a second output time difference L2 may be smaller than or equal to the first output time difference L1. In an (N)th horizontal period corresponding to an (N)th pixel that is located farthest from the data driver, an (N)th output time difference Ln may be relatively small to secure the charging time.

Figure 6:
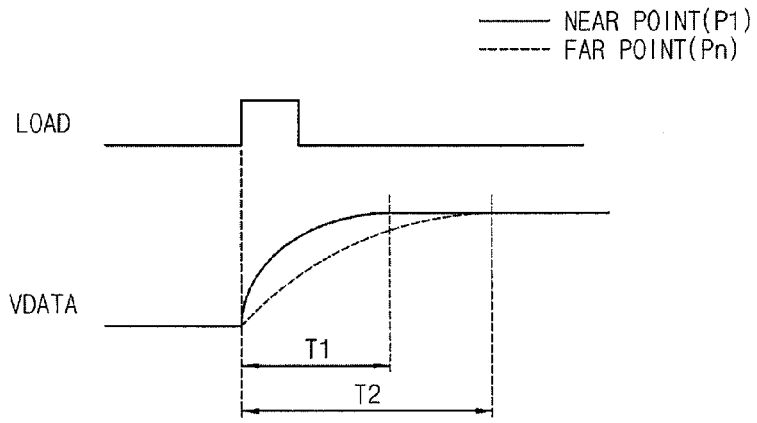
FIG. 6 is a diagram illustrating a data signal charged in a pixel according to an output timing of a load signal.

FIG. 6 is a diagram illustrating a data signal charged in a pixel according to an output timing of a load signal.

Referring to FIG. 6, a data driver may output the data signal VDATA as a load signal LOAD is outputted. A first pixel P1 that is located nearest to the data driver may be relatively little affected (e.g., minimally affected) by the line load. Accordingly, a first charging time T1 of the data signal for the first pixel P1 may be relatively short. On the other hand, an (N)th pixel Pn that is located farthest from the data driver may be more affected (e.g., relatively largely affected) by the line load. Accordingly, a second charging time T2 of the data signal for the (N)th pixel Pn may be relatively long.

Figure 7:
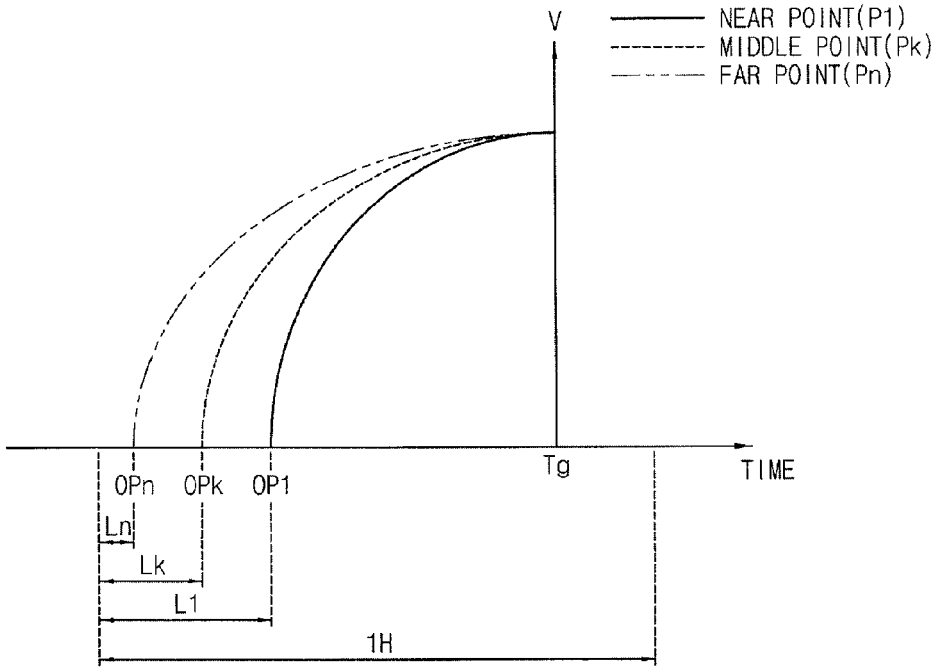
FIG. 7 is a graph illustrating an output timing of a data signal according to a position of a pixel.

FIG. 7 is a graph illustrating an output timing of a data signal according to a position of a pixel.

Referring to FIG. 7, the output timing of the data signal may be adjusted within one horizontal period 1H based on a position of the pixel. A first pixel P1 that is located nearest to the data driver may have a relatively short charging time. The output timing of the data signal for the first pixel P1 may be slow (e.g., delayed) within one horizontal period 1H to reduce power consumption. Therefore, the data signal for the first pixel P1 may be outputted at a first output timing OP1, and a first output time difference L1 may be relatively long. Although the data signal for the first pixel P1 is outputted at the first output timing OP1, the data signal may be charged in (e.g., stored in) the first pixel P1 within a target charging time Tg.

A (K)th pixel Pk located between the first pixel P1 and an (N)th pixel Pn may have a charging time longer than the charging time of the first pixel P1. The data signal for the (K)th pixel Pk may be outputted at a (K)th output timing OPk faster than (e.g., before) the first output timing OP1, and a (K)th output time difference Lk may be shorter than the first output time difference L1. Although the data signal for the (K)th pixel Pk is outputted at the (K)th output timing OPk, the data signal may be charged in the (K)th pixel Pk within the target charging time Tg.

The (N)th pixel Pn that is located farthest from the data driver may have a relatively long charging time. The output timing of the data signal for the (N)th pixel Pn may be fast (e.g., with little to no delay) within one horizontal period 1H to secure the charging time. Therefore, the data signal for the (N)th pixel Pn may be outputted at an (N)th output timing OPn, and an (N)th output time difference Ln may be relatively short. Because the data signal for the (N)th pixel Pn is outputted at the (N)th output timing OPn corresponding to the (N)th output time difference that is relatively short, the data signal may be charged in the (N)th pixel Pn within the target charging time Tg.

Figure 8A:
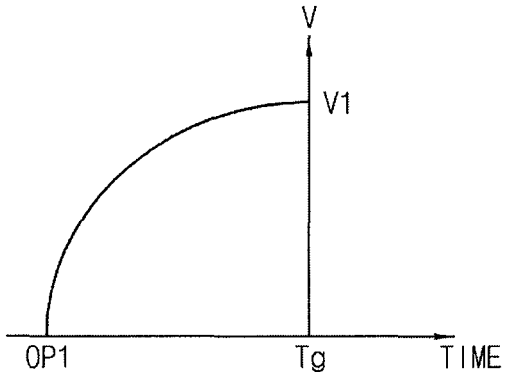
FIGS. 8A through 8C are graphs for describing an effect for reducing power consumption by adjusting an output timing of the data signal.
Figure 8B:
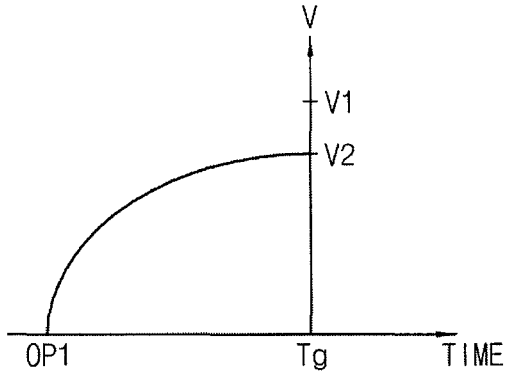
Figure 8C:
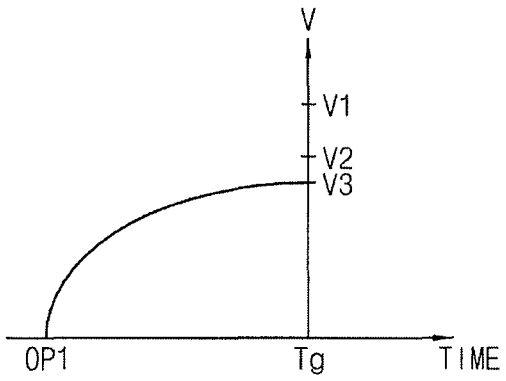

FIGS. 8A through 8C are graphs for describing a process for reducing power consumption by adjusting an output timing of the data signals.

Referring to FIGS. 8A through 8C, an output timing of a data signal for a first pixel that is located in the nearest distance from the data driver may be delayed as a first output timing OP1 within one horizontal period, thereby reducing power consumption.

As shown in FIG. 8A, the data signal for the first pixel may be outputted through a data line, and the first pixel may be charged with the data signal to display an image. The first pixel may be relatively little affected (e.g., minimally affected) by the line load. Therefore, although the output timing of the data signal for the first pixel may be delayed as the first output timing OP1, the first pixel may be charged with a first voltage level V1 corresponding to the data signal within the target charging time Tg.

As shown in FIG. 8B, the data signal for the first pixel may be outputted through a data line, and the data signal for the first pixel may be applied to a (K)th pixel located between the first pixel and an (N)th pixel because the (K)th pixel is connected to the same data line with the first pixel. At a time when the data signal for the first pixel is applied to the (K)th pixel, a scan signal may not be applied to the (K)th pixel. Therefore, the (K)th pixel may not emit the light as a result of the data signal for the first pixel. Thus, the (K)th pixel may be unnecessarily charged by the data signal for the first pixel. Because the (K)th pixel is affected by the line load to a greater degree as compared to the first pixel, a second voltage level V2 applied to the (K)th pixel may be lower than the first voltage level V1. Amount of a current charged in a capacitor in the pixel may be determined using [Equation 1] below, $$I = C\frac{dV}{dT}, \qquad \text{Equation 1}$$

where I is the current charged in a capacitor in the pixel, C is a capacitance of the capacitor, dV is a voltage difference between both electrodes of the capacitor, and dT is a time difference. Therefore, the current consumed by the pixel may be proportional to a charging voltage.

The data signal for the first pixel may not be used for the (K)th pixel. The charging voltage for the (K)th pixel may be decreased from the first voltage level V1 to the second voltage level V2 by delaying the output timing of the data signal for the first pixel. Therefore, the unnecessary voltage charged in the (K)th pixel may be decreased to reduce power consumption.

As shown in FIG. 8C, the data signal for the first pixel may be outputted through a data line, and the data signal for the first pixel may be applied to the (N)th pixel located farthest from the data driver because the (N)th pixel is connected to the same data line as the first pixel. Although the data signal for the first pixel is applied to the (N)th pixel, the scan signal is not applied to the (N)th pixel. Therefore, the (N)th pixel does not emit light based on the data signal for the first pixel. Thus, the (N)th pixel may be unnecessarily charged by the data signal for the first pixel. Because the (N)th pixel is more greatly affected by the line load as compared to the first pixel and the (K)th pixel, a third voltage level V3 applied to the (N)th pixel is lower than the first voltage level V1 and the second voltage level V2. The data signal for the first pixel is not used for the (N)th pixel. The charging voltage for the (N)th pixel may be decreased from the first voltage level V1 to the third voltage level V3 by delaying the output timing of the data signal for the first pixel. Therefore, the unnecessary voltage charged in the (N)th pixel may be decreased to reduce power consumption.

Figure 9:
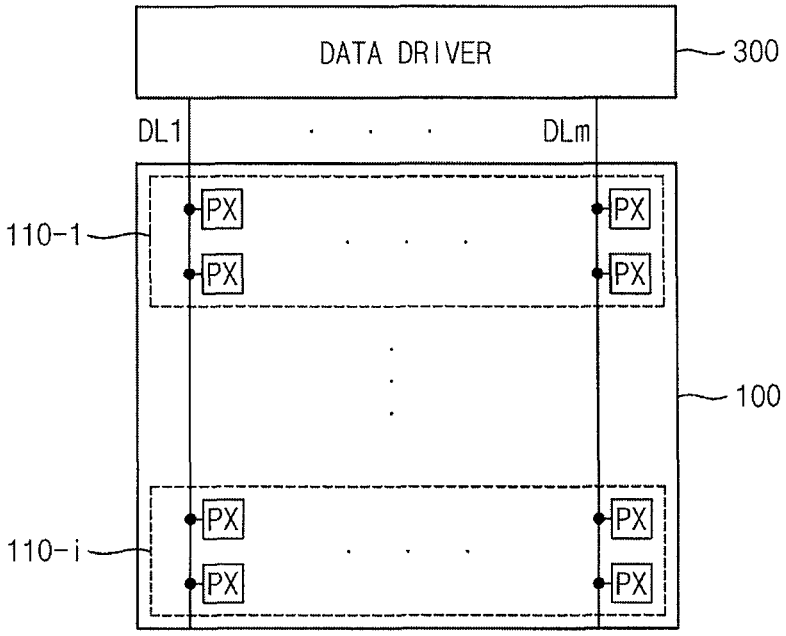
FIG. 9 is a block diagram illustrating a data driver and a display panel according to example embodiments of the present invention.

FIG. 9 is a block diagram illustrating a data driver and a display panel according to example embodiments.

Referring to FIG. 9, the data driver 300 may adjust an output timing for each of the pixel regions 110-1 through 110-*i*.

The display panel 100 may include a plurality of pixels PX to display an image. The display panel 100 may be connected to the data driver 300 via a plurality of data lines DL1 through DLm. The display panel 100 may include n*m pixels PX because the pixels PX are arranged at locations corresponding to crossings (e.g., crossing points) of the scan lines and the data lines DL1 through DLm.

In addition, the display panel 100 may be divided into a plurality of pixel regions 110-1 through 110-*i*. For example, each of the pixel regions 110-1 through 110-*i* may have substantially the same number of the scan lines. In one example embodiment, the number of the pixel regions 110-1 through 110-*i* may correspond to a size of a protocol for setting the output timing of the load signal. For example, when the size of the protocol for setting the output timing of the load signal is 6 bits, the number of the pixel regions 110-1 through 110-*i* may be 64.

The data driver 300 may provide the data signals to the pixels PX through the data lines DL1 through DLm. The data driver 300 may include a signal controller, a shift register, a latch circuit, a digital-to-analog converter, and an output buffer. Because the data driver 300 is described above, duplicated descriptions may not be provided.

The signal controller may receive a second control signal from the timing controller. The signal controller may generate signals for controlling the shift register and the latch circuit based on the second control signal. The signal controller may generate a load signal based on the second control signal and provide the load signal to the latch circuit. The signal controller may adjust an output timing of the load signal according to the distance from the pixels PX.

In addition, the signal controller may set the output timing of the load signal for each of the pixel regions 110-1 through 110-*i*. Specifically, the number of scan lines included in the display panel 100 may be increase as a resolution of the display device increases. For example, the number of scan lines are 1080 in the display device that supports 1920*1080 (i.e., full HD) resolution. Also, the output timing of the load signal may be adjusted to the limited number of timings. For example, when the size of the protocol for setting the output timing of the load signal is 6 bits, the output timing of the load signal may be set as one of 64 timings within one horizontal period. Therefore, the signal controller may set the output timing of the load signal for each of the pixel regions 110-1 through 110-*i*. For example, in the display device supporting full HD resolution, the display panel 100 may be divided into 64 pixel regions, and each pixel region includes 17 scan lines. In one example embodiment, the signal controller may output the load signal such that the output timing of the load signal is advanced (e.g., decreased) as a distance between the data driver 300 and the pixel region increases. For example, when each pixel region includes 17 scan lines, the signal controller may check whether or not the pixel region is changed using the counter and set the output timing of the load signal relatively fast (e.g., reduce the delay in the output timing of the load signal) as the distance between the data driver 300 and the pixel region increases.

The shift register may shift a horizontal start signal synchronizing a data clock signal to generate a sampling signal.

The latch circuit may latch input data in response to the sampling signal, and output the latched input data in response to the load signal.

The digital-to-analog converter may convert the latched input data into the data signals of analog-type (e.g., into analog data signals) based on a gamma reference voltage set.

The output buffer may output the data signals D1 through Dm to the data lines.

Therefore, the display device may adjust the output timing of the data signals according to the distance between the data driver 300 and the pixel regions 110-1 through 110-*i*. Accordingly, the display device may decrease unnecessary voltage for charging pixels PX and reduce power consumption.

Although the example embodiments describe that the display device is the organic light emitting display device, types of the display device are not limited thereto.

The present inventive concept may be applied to an electronic device having the organic light emitting display device. For example, the present inventive concept may be applied to a computer, a notebook computer, a cellular phone, a smart phone, a smart pad, a personal digital assistant (PDA), and/or the like.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the terms "use," "using," and "used" may be considered synonymous with the terms "utilize," "utilizing," and "utilized," respectively.

The data driver and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the data driver may be formed on one integrated circuit (IC) chip or on separate IC chips. Further, the various components of the data driver may be implemented on a flexible printed circuit film, a tape carrier package (TCP), a printed circuit board (PCB), or formed on a same substrate. Further, the various components of the data driver may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and aspects of the present inventive concept. Accordingly, all such modifications are intended to be included within the scope of the present inventive concept as defined by the claims, and equivalents thereof.

What is claimed is:

1. A display device comprising:

a display panel comprising a plurality of pixels;

a scan driver configured to provide a plurality of scan signals to the pixels through a plurality of scan lines;

a data driver configured to adjust an output timing of a data signal of a plurality of data signals according to a distance from a target pixel of the pixels, and to provide the data signal to the pixels through a plurality of data lines; and a timing controller configured to control the scan driver and the data driver, wherein the data driver comprises:

a shift register configured to shift a horizontal start signal synchronizing a data clock signal to generate a sampling signal;

a latch circuit configured to latch input data in response to the sampling signal, and to output the latched input data in response to a load signal; and a signal controller configured to adjust an output timing of the load signal according to the distance from the pixels, and to provide the load signal to the latch circuit, wherein the signal controller is further configured to output the load signal in every horizontal period, each horizontal period comprising a horizontal blank period and a data outputting period, and to decrease an output time difference between a start time of the horizontal blank period and the output timing of the load signal as a distance between the data driver and the pixels increases.

2. The display device of claim 1, wherein the data driver is configured to output the data signal such that the output timing of the data signal is advanced within one horizontal period as a distance between the data driver and the target pixel of the pixels increases.

3. The display device of claim 1, wherein the data driver further comprises:

a digital-to-analog converter configured to convert the latched input data into the data signals of analog-type based on a gamma reference voltage set; and an output buffer configured to output the data signals to the data lines.

4. The display device of claim 3, wherein the signal controller is configured to adjust the output timing of the load signal such that the pixels are charged with the data signals within a target charging time.

5. The display device of claim 3, wherein the display panel comprises a plurality of pixel regions, and wherein the signal controller is configured to set the output timing of the load signal for each of the pixel regions.

6. The display device of claim 5, wherein the signal controller is configured to output the load signal such that the output timing of the load signal is advanced as a distance between the data driver and the pixels increases.

7. The display device of claim 5, wherein a quantity of the pixel regions corresponds to a size of a protocol for setting the output timing of the load signal.

8. The display device of claim 3, wherein the scan driver is configured to progressively output the scan signals to the scan lines, and wherein the signal controller is configured to control the output timing of the load signal using a counter that is increased in every horizontal period.

9. The display device of claim 3, wherein the scan driver is configured to output the scan signals to the scan lines in a set order, and wherein the signal controller is configured to control the output timing of the load signal based on the scan signals.

10. The display device of claim 3, wherein the signal controller is further configured to receive a control signal from the timing controller, and to provide the horizontal start signal and the data clock signal to the shift register based on the control signal.

11. The display device of claim 1, wherein the signal controller is configured to output the load signal for at least a portion of the horizontal blank period.

12. A display device comprising:

a display panel comprising a plurality of pixels;

a scan driver configured to provide a plurality of scan signals to the pixels through a plurality of scan lines;

a data driver configured to adjust an output timing of a data signal of a plurality of data signals according to a distance from a target pixel of the pixels, and to provide the data signal to the pixels through a plurality of data lines; and a timing controller configured to control the scan driver and the data driver, wherein the data driver comprises:

a shift register configured to shift a horizontal start signal synchronizing a data clock signal to generate a sampling signal;

a latch circuit configured to latch input data in response to the sampling signal, and to output the latched input data in response to a load signal;

a signal controller configured to adjust an output timing of the load signal according to the distance from the pixels, and to provide the load signal to the latch circuit;

a digital-to-analog converter configured to convert the latched input data into the data signals of analog-type based on a gamma reference voltage set; and an output buffer configured to output the data signals to the data lines, wherein the signal controller outputs the load signal in every horizontal period, wherein the horizontal period comprises a horizontal blank period and a data outputting period, wherein the signal controller is configured to output the load signal for at least a portion of the horizontal blank period, and wherein the signal controller decreases an output time difference between a start time of the horizontal blank period and the output timing of the load signal as a distance between the data driver and the pixels increases.

13. The display device of claim 12, wherein the signal controller is configured to calculate the output time difference for each of the pixels using an interpolation method.

14. A data driver comprising:

a shift register configured to shift a horizontal start signal synchronizing a data clock signal to generate a sampling signal;

a latch circuit configured to latch input data in response to the sampling signal, and to output the latched input data in response to a load signal;

a signal controller configured to adjust an output timing of the load signal according to a distance from a plurality of pixels, and to provide the load signal to the latch circuit;

a digital-to-analog converter configured to convert the latched input data into a plurality of data signals of analog-type based on a gamma reference voltage set; and an output buffer configured to output the data signals to a plurality of data lines, wherein the signal controller is configured to output the load signal in every horizontal period, wherein the horizontal period comprises a horizontal blank period and a data outputting period, and wherein the signal controller is configured to output the load signal for at least a portion of the horizontal blank period, wherein the signal controller is configured to decrease an output time difference between a start time of the horizontal blank period and the output timing of the load signal as a distance between the data driver and the pixels increases.

15. The data driver of claim 14, wherein the signal controller is configured to calculate the output time difference for each of the pixels using an interpolation method.

16. The data driver of claim 14, wherein the signal controller is configured to adjust the output timing of the load signal such that the pixels are charged with the data signals within a target charging time.

* * * * *